US007280006B2

(12) United States Patent
Hase

(10) Patent No.: US 7,280,006 B2
(45) Date of Patent: Oct. 9, 2007

(54) HIGH-FREQUENCY SWITCH CIRCUIT DEVICE

(75) Inventor: Eiichi Hase, Tokyo (JP)

(73) Assignee: Hitachi Kousai Electric Inc., Tokyo (JP)

( * ) Notice: Subject to any disclaimer, the term of this patent is extended or adjusted under 35 U.S.C. 154(b) by 182 days.

(21) Appl. No.: 11/256,921

(22) Filed: Oct. 25, 2005

(65) Prior Publication Data

US 2006/0087389 A1 Apr. 27, 2006

(30) Foreign Application Priority Data

Oct. 25, 2004 (JP) ..... 2004-309808

(51) Int. Cl.
*H01P 1/15* (2006.01)

(52) U.S. Cl. ..... 333/103; 333/104

(58) Field of Classification Search ..... 333/101, 333/103, 104, 262

See application file for complete search history.

(56) References Cited

U.S. PATENT DOCUMENTS 5,109,205 A * 4/1992 Hart et al. ..... 333/104
5,193,218 A * 3/1993 Shimo ..... 455/80
5,519,364 A * 5/1996 Kato et al. ..... 333/103
6,552,626 B2 * 4/2003 Sharpe et al. ..... 333/104

FOREIGN PATENT DOCUMENTS

| | | |
|---|---|---|
| JP | 6232659 | 8/1994 |
| JP | 7326909 | 12/1995 |
| JP | 08-032302 | 2/1996 |
| JP | 10-112618 | 4/1998 |
| JP | 2003 198203 | 7/2003 |
| JP | 2004-015583 | 1/2004 |
| JP | 2004 236085 | 8/2004 |

* cited by examiner

*Primary Examiner*—Dean Takaoka
(74) *Attorney, Agent, or Firm*—Mattingly, Stanger, Malur & Brundidge, P.C.

(57) ABSTRACT

A high frequency switch circuit device includes: at least one distributed element of at least one transmission line; at least two lumped elements of at least one resistor and at least one capacitor; at least one semiconductor device; at least one input terminal; at least two output terminals; and another transmission line, having an open end or a short-circuited end, connected to the input terminal. A total length of the input terminal and said another transmission line is set to be about an integer times λ/2 in case the transmission line has the open end and about an integer times (λ/4+λ/2) in case the transmission line has the short-circuited end. One of the output terminals is used as an input port to which a signal is inputted, and another one of the output terminals is used as an output port from which a signal is outputted.

6 Claims, 8 Drawing Sheets

HIGH-FREQUENCY SWITCH CIRCUIT DEVICE

FIELD OF THE INVENTION

The present invention relates to a high frequency switch device for use in a wireless data communications apparatus, an image transmission apparatus and the like; and, more particularly, to a high frequency switch device including a single input terminal and a plurality of output terminals or a single output terminal and a plurality of input terminals.

BACKGROUND OF THE INVENTION

Among high frequency switch circuit devices employed in, for example, wireless data communications apparatuses or image transmission apparatuses, such apparatuses as, e.g., an antenna changeover switch and a signal modulation switch have different functions, so implementing them with a single device has been difficult. However, in view of reducing the number of semiconductor chips to install the apparatuses and simplifying the structure thereof, it becomes important to implement multiple functions with a signal device.

As an example of a semiconductor antenna changeover switch among the high frequency switch circuit devices for use in the conventional wireless data communications apparatuses or image transmission apparatuses, there has been known a semiconductor switch circuit device having a single input terminal and two output terminals, wherein distributed elements of transmission lines, capacitors and diodes are formed on a same surface on a semiconductor substrate (see, for example, Reference 1: E. Alekseev, et al., "77 GHz High-Isolation Coplanar Transmit/Receive Switch Using InGaAs/InP PIN Diodes", 1998 IEEE GaAs IC Symposium).

In accordance with this configuration, each of the two output terminals is connected to a central point via a distributed element of a transmission line, a diode, and/or a capacitor and then to the input terminal via a distributed element of a transmission line.

Also in this configuration, the widths of the transmission lines are designed such that the impedances of the distributed elements of the transmission lines become identical to that of a system connected to the input and output terminals. In case a high frequency signal source is connected to the input terminal and a resistive load is coupled to each of the two output terminals, a high frequency input signal from the input terminal is switched to be outputted to the two output terminals by an on/off operation of the diodes. However, in case of switching on/off the high frequency input signal by connecting the high frequency signal source to one of the two output terminals and connecting a resistive load to the other output terminal, a part of the high frequency input signal is reflected by the input terminal and the distributed elements of the transmission lines led to the input terminal, thus increasing a loss of the high frequency signal.

With regard to the technique disclosed in Reference 1, if the semiconductor switch circuit having the one input terminal and the two output terminals is to be employed as a circuit for switching on/off the high frequency signal by connecting the high frequency signal source to one of the output terminals and the resistive load to the other, the input terminal and the distributed element of the transmission line led to the input terminal would not be necessary. However, to be used as a semiconductor switch circuit having one input terminal and two output terminals, the input terminal and the distributed elements of the transmission lines led to the input terminal are essential circuit elements, and there is a limit to reducing the loss of the high frequency signal by reducing the sizes of the input terminal and the distributed elements of the transmission lines led to the input terminal.

FIG. 13 provides an equivalent circuit diagram to illustrate a general circuit configuration of a semiconductor switch circuit including distributed elements of transmission lines, lumped elements of resistors and capacitors, at least one input terminal and two or more output terminals.

As shown therein, an input terminal 1, a distributed element 2 made of a transmission line whose length is about 2n−1 times λ/4 (n represents a natural number), a distributed element 4 made of a transmission line whose length is about 2n times λ/4 and an output terminal 6 are sequentially connected in series. A semiconductor 3 for switching operation is connected to the distributed elements 2 and 4, while a semiconductor 5 for a switching operation is connected to the distributed element 4 and the output terminal 6. Further, resistors 7 and 8 for controlling the semiconductors 3 and 5, respectively, are connected to a control terminal 9 and are grounded via a chip capacitor 10. Moreover, the input terminal 1, a distributed element 11 made of a transmission line whose length is about 2n−1 times λ/4, a distributed element 13 made of a transmission line whose length is about 2n times λ/4 and another output terminal 15 are sequentially connected in series. Also, a semiconductor 12 for switching operation is connected to the distributed elements 11 and 13 while a semiconductor 14 for switching operation is coupled to the distributed element 13 and the output terminal 15. Further, resistors 16 and 17 for controlling the semiconductors 12 and 14, respectively, are connected to a control terminal 18, and are grounded via a chip capacitor 19.

Referring to FIG. 14, there is shown a semiconductor switch circuit device obtained by forming the circuit in FIG. 13 on a semiconductor substrate.

In FIG. 14, the dielectric constant of the semiconductor substrate 20 is set to be 13.5, while its thickness is set to be 0.08 mm. Further, the widths of the transmission lines of the distributed elements 2, 4, 11 and 13 are set to be 0.054 mm; the resistor 7, 8, 16 and 17 are set to be 100Ω; the chip capacitors 10 and 19 are set to be 100 pF; and the sizes of the input terminal 1 and the output terminals 6 and 15 are set to be 0.1×0.12 mm.

FIG. 15 sets forth a graph to describe estimated values of transmission loss when a high frequency signal of a frequency ranging from 50 to 70 GHz is transmitted in the semiconductor switch circuit device configured as illustrated in FIG. 14.

In FIG. 15, a curve 15-1 represents a transmission loss of the high frequency signal transmitted from the input terminal 1 to the output terminal 15 when the turn-on resistances of the semiconductors 3 and 5 are set to be 2Ω and the turn-off resistances of the semiconductors 12 and 14 are set to be 2 kΩ. Further, curves 15-2 and 15-3 indicate a reflection loss of the high frequency signal at the input terminal 1 and a transmission loss, i.e., isolation of the high frequency signal transmitted from the input terminal 1 to the output terminal 6, respectively, under the same conditions. Moreover, a curve 15-4 represents a transmission loss of the high frequency signal transmitted from the input terminal 1 to the output terminal 15 when the turn-on resistances of the semiconductors 3 and 5 are set to be 2Ω; the turn-off resistances of the semiconductors 12 and 14 are set to be 2 kΩ; and the sizes of the input terminal 1 and the output terminals 6 and 15 are set to be as small as 0.074×0.02 mm.

Further, curves 15-5 and 15-6 represent a reflection loss of the high frequency signal at the input terminal 1 and a transmission loss, i.e., isolation of the high frequency signal transmitted from the input terminal 1 to the output terminal 6, respectively, under the same conditions.

As can be seen from FIG. 15, when using the circuit device for switching a high frequency signal, if the sizes of the input terminal 1 and the output terminals 6 and 15 are extremely reduced, the reflection loss of the high frequency signal at the input terminal 1 can be reduced, but the transmission loss of the high frequency signal is not much influenced. Moreover, in order to connect the circuit externally, the input terminal 1 cannot be omitted therein.

FIG. 16 sets forth a graph to describe estimated values of transmission loss of a high frequency signal of a frequency ranging from 50 to 70 GHz when the high frequency signal is transmitted from the output terminal 6 to the other output terminal 15 by opening the input terminal 1 in the semiconductor switch circuit device configured as illustrated in FIG. 14.

In FIG. 16, a curve 16-1 represents a transmission loss of the high frequency signal transmitted from the output terminal 6 to the output terminal 15 when the turn-off resistances of the semiconductors 3, 5, 12 and 14 are set to be 2 kΩ. Further, a curve 16-2 indicates a reflection loss of the high frequency signal at the output terminal 6 under the same condition. Further, a curve 16-3 depicts a transmission loss, i.e., isolation of the high frequency signal transmitted from the output terminal 6 to the output terminal 15 when the turn-on resistances of the semiconductors 3, 5, 12 and 14 are set to be 2Ω. Moreover, a curve 16-4 indicates a transmission loss of the high frequency signal transmitted from the output terminal 6 to the output terminal 15 under the condition that: the turn-off resistances of the semiconductors 3, 5, 12 and 14 are set to be 2 kΩ; the sizes of the input terminal 1 and the output terminals 6 and 15 are set to be as small as 0.074×0.02 mm; and the input terminal 1 is opened. A curve 16-5 represents a reflection loss of the high frequency signal at the output terminal 6 under the same conditions, and a curve 16-6 depicts a transmission loss, i.e., isolation of the high frequency signal transmitted from the output terminal 6 to the output terminal 15 under the condition that: the turn-on resistances of the semiconductors 3, 5, 12 and 14 are set to be 2Ω; the sizes of the input terminal 1 and the output terminals 6 and 15 are set to be as small as 0.074×0.02 mm; and the input terminal 1 is opened.

As can be seen from FIG. 16, when using the conventional high frequency switch circuit in such a manner that a high frequency signal is inputted to one of the output terminals and outputted from the other output terminal, the reflection loss of the high frequency signal of the frequency ranging from 57 to 65 GHz at the output terminal 6 is reduced down to 7 dB or less due to a reflection at the input terminal 1 and so forth. However, if the sizes of the input terminal 1 and the output terminals 6 and 15 becomes extremely small, their influences upon the transmission loss of the high frequency signal transmitted from the output terminal 6 to the output terminal 15 decreases, so that the reflection loss of the high frequency signal at the output terminal 6 increases up to 20 dB or greater and the transmission loss of the high frequency signal from the output terminal 6 to the output terminal 15 is reduced down to about 2.1 dB or less. However, although the reflection loss and the transmission loss of the high frequency signal would be reduced without the input terminal 1, the input terminal 1 cannot be omitted in the high frequency switch circuit device because the input terminal 1 have to be connected externally in order to implement multiple functions with a single device. Thus, since the input terminal 1 is included therein, the transmission loss of the high frequency signal from the output terminal 6 to the output terminal 15 increases. Therefore, implementing a high frequency on/off switch as well as, e.g., an antenna changeover switch, a signal modulation circuit, and the like with a single device is difficult because their functions are different.

SUMMARY OF THE INVENTION

It is, therefore, an object of the present invention to provide a high frequency switch circuit device including an input terminal, capable of reducing a transmission loss of a high frequency signal transmitted from one output terminal to another.

In accordance with one aspect of the present invention, there is provided a high frequency switch circuit device comprising: a distributed element of a transmission line; a resistor and a capacitor which are lumped elements; a semiconductor; at least one input terminal; and at least two output terminals, wherein the transmission line, having an open end or a short-circuited end, is connected to the input terminal, and a total length of the input terminal and the transmission line is set to be about integer times λ/2 in case the transmission line has the open end and about integer times (λ/4+λ/2) in case the transmission line has the short-circuited end.

Preferably, one of the output terminals is set as an input port to which a signal is inputted, and another one of the output terminals is set as an output port from which a signal is outputted.

Preferably, the transmission line connected to the input terminal is formed on a dielectric substrate or a semiconductor substrate.

In accordance with another aspect of the present invention, there is provided a high frequency switch circuit device comprising: a distributed element of a transmission line; a resistor and a capacitor which are lumped elements; a semiconductor; at least one output terminal; and at least two input terminals, wherein the transmission line, having an open end or a short-circuited end, is connected to the output terminal, and a total length of the output terminal and the transmission line is set to be about integer times λ/2 in case the transmission line has the open end and about integer times (λ/4+λ/2) in case the transmission line has the short-circuited end.

Preferably, one of the input terminals is set as an input port to which a signal is inputted, and another one of the input terminals is set as an output port from which a signal is outputted.

Preferably, the transmission line connected to the output terminal is formed on a dielectric substrate or a semiconductor substrate.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

In the following, preferred embodiments of the present invention will be described with reference to the accompanying drawings.

Figure 1:
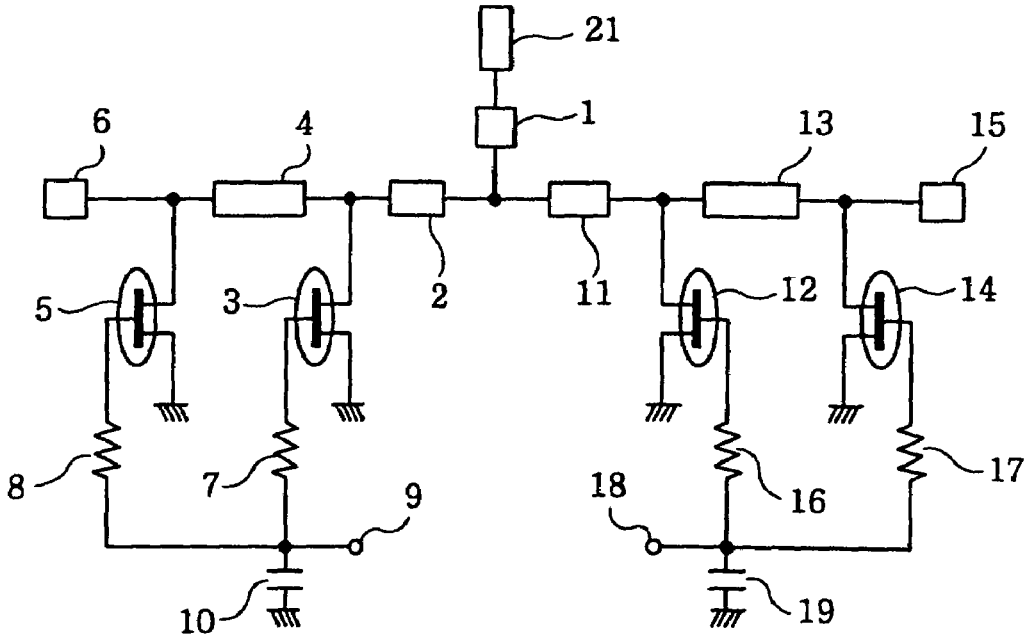
FIG. 1 is a circuit diagram of a high frequency switch circuit device in accordance with a first preferred embodiment of the present invention.
Figure 13:
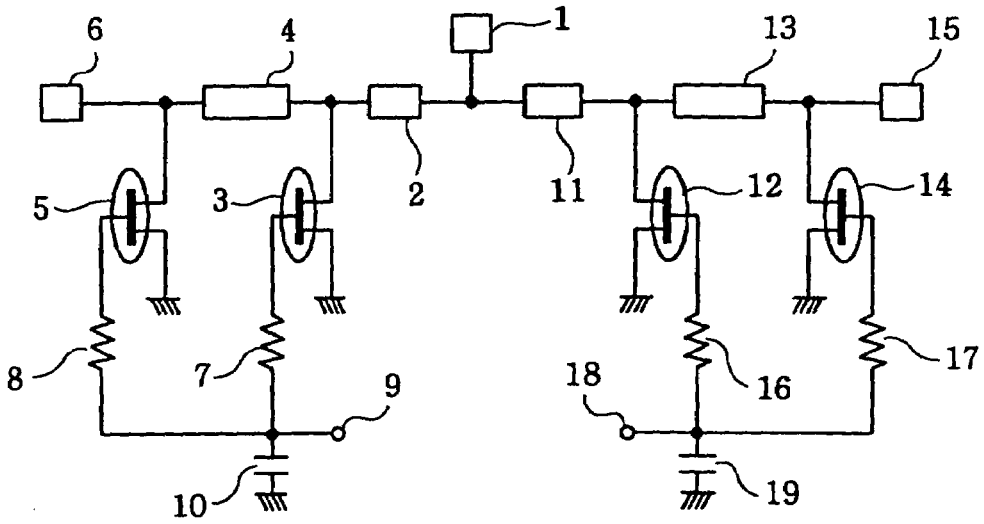
FIG. 13 (PRIOR ART)
FIG. 13 illustrates an equivalent circuit diagram of a conventional high frequency switch circuit device.
Figure 14:
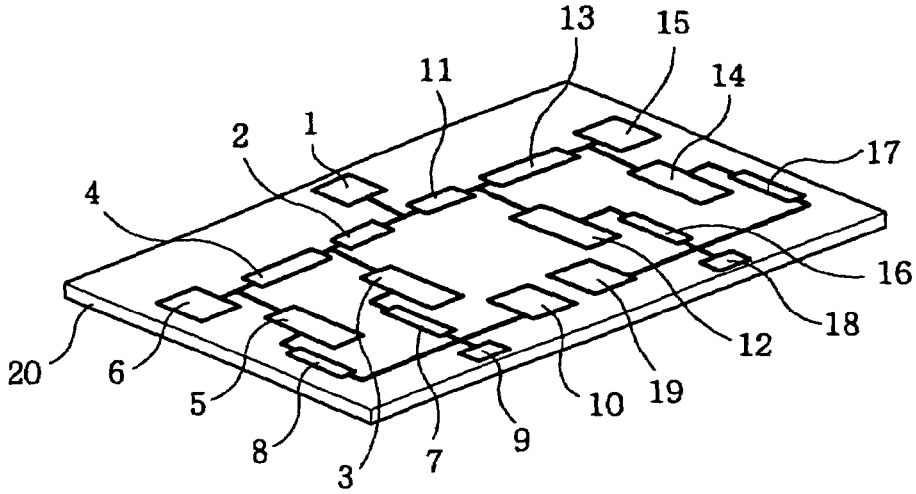
FIG. 14 (PRIOR ART)
FIG. 14 shows a configuration of the high frequency switch circuit device obtained by forming the circuit in FIG. 13 on a substrate.
Figure 15:
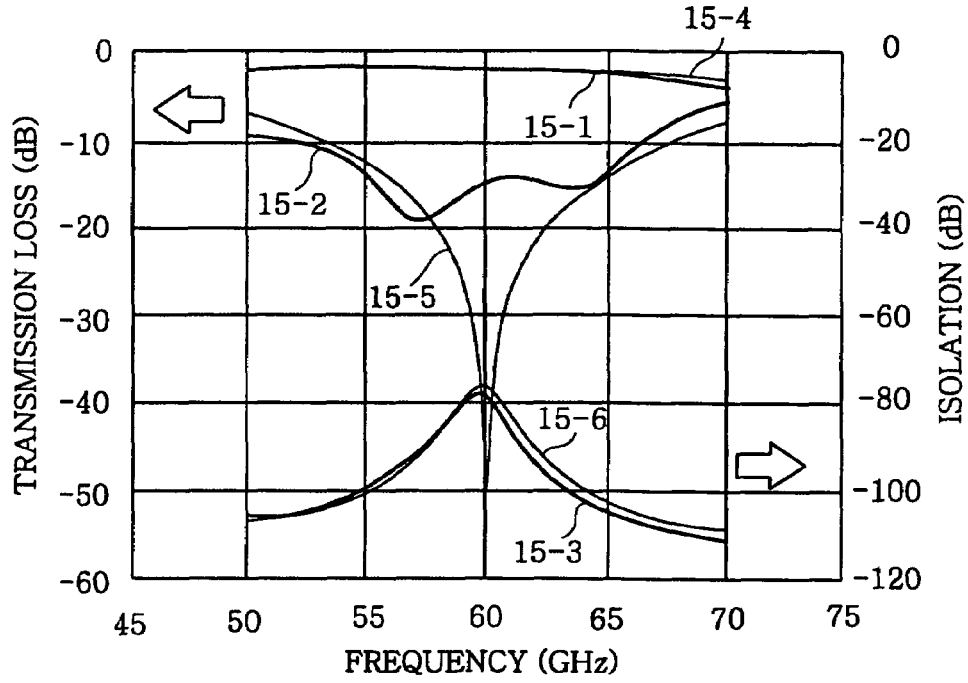
FIG. 15 (PRIOR ART)
FIG. 15 presents a graph to represent estimated high frequency characteristics of the high frequency switch circuit device shown in FIG. 14.
Figure 16:
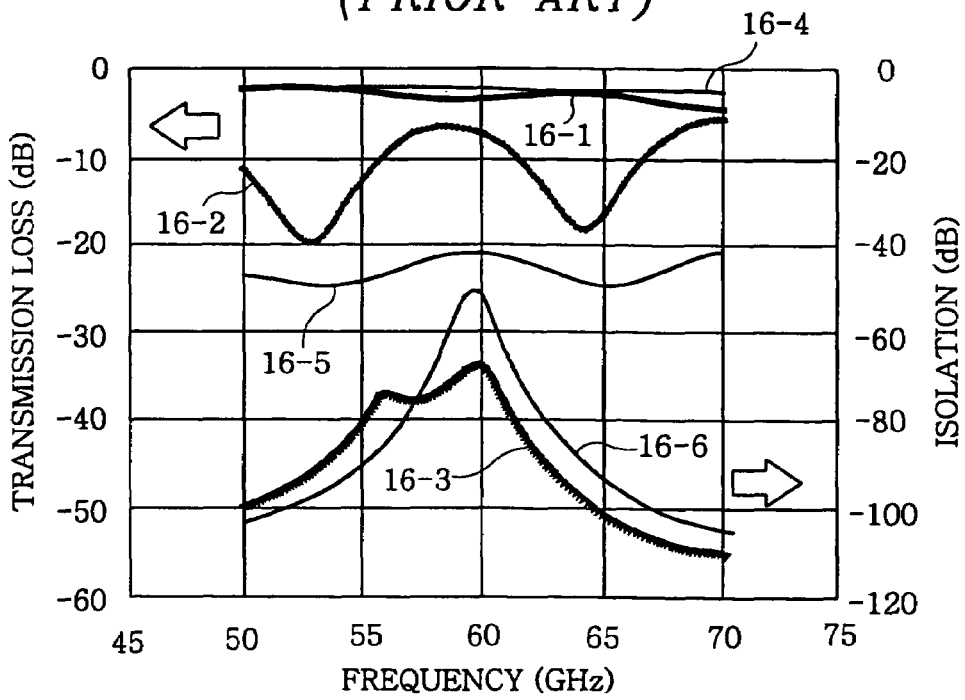
FIG. 16 (PRIOR ART)
FIG. 16 sets forth a graph to represent estimated high frequency characteristics of the high frequency switch circuit device shown in FIG. 14 when the device is operated as an on-off switch.

FIG. 1 shows an equivalent circuit diagram to describe a circuit configuration of a high frequency switch circuit device in accordance with a first preferred embodiment of the present invention. Reference numeral 21 represents a distributed element. Herein, parts identical or equivalent to those described in FIG. 13 will be assigned same reference numerals.

As shown therein, an input terminal 1, a distributed element 2 made of a transmission line whose length is about 2n−1 times λ/4 (herein and hereinafter, n represents an integer), a distributed element 4 made of a transmission line whose length is about 2n times λ/4 and an output terminal 6 are sequentially connected in series. A semiconductor 3 for switching operation is connected to the distributed elements 2 and 4, while a semiconductor 5 for a switching operation is connected to the distributed element 4 and the output terminal 6. Further, resistors 7 and 8 for controlling the semiconductors 3 and 5, respectively, are connected to a control terminal 9 and are grounded via a chip capacitor 10.

Moreover, the input terminal 1, a distributed element 11 made of a transmission line whose length is about 2n−1 times λ/4, a distributed element 13 made of a transmission line whose length is about 2n times λ/4 and another output terminal 15 are sequentially connected in series. Also, a semiconductor 12 for switching operation is connected to the distributed elements 11 and 13 while a semiconductor 14 for switching operation is coupled to the distributed element 13 and the output terminal 15. Further, resistors 16 and 17 for controlling the semiconductors 12 and 14, respectively, are connected to a control terminal 18, and are grounded via a chip capacitor 19. In addition, the distributed element 21 made of a transmission line with an open end is connected to the input terminal 1, and the total length of the input terminal 1 and the transmission line of the distributed element 21 is set to be about integer times λ/2.

In this circuit configuration, by turning on/off the semiconductors 3, 5, 12 and 14, either one of the output terminals 6 and 15 can be selected such that a high frequency signal inputted from the input terminal 1 can be outputted to the selected one among the output terminals 6 and 15. It is also possible to set one of the output terminals 6 and 15 as an input port and the other as an output port such that a high frequency signal inputted from one output terminal to the other. Furthermore, it is also possible to use both of the output terminals 6 and 15 as input ports, while using the input terminal 1 as an output port. In such a case, two terminals are used as input ports, so either one of them can be selected by turning on/off the semiconductors 3, 5, 12, and 14. These options are also applicable to other preferred embodiments to be described later.

Further, in this circuit configuration, if one of the output terminals 6 and 15 is used as an input port and the other is used as an output port such that a high frequency signal is outputted from the one of the output terminal to the other, an impedance due to the input terminal 1 and the distributed element 21 becomes infinite by setting the total length of the input terminal 1 and the transmission line of the distributed element 21 to be about integer times λ/2. As a consequence, a reflection of the high frequency signal from the input terminal 1 does not influence upon the transmission loss thereof.

Figure 2:
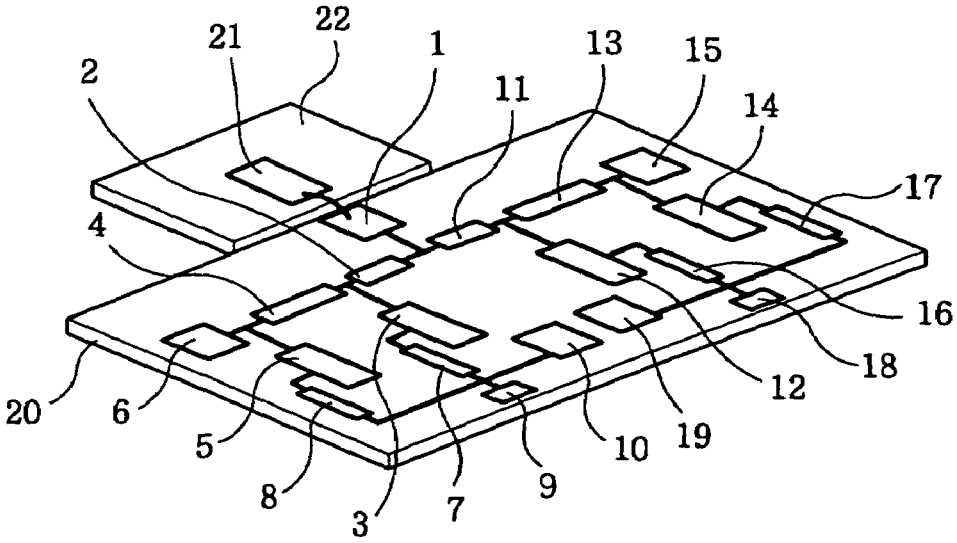
FIG. 2 illustrates a configuration of the high frequency switch circuit device obtained by forming the circuit in FIG. 1 on a substrate in accordance with the first embodiment of the present invention.

FIG. 2 illustrates a configuration of the high frequency switch circuit device obtained by forming the circuit in FIG. 1 on a substrate in accordance with the first embodiment of the present invention. Reference numeral 22 represents a substrate. Herein, parts identical to or equivalent to those descried in FIG. 1 will be assigned same reference numerals, and description thereof will be omitted.

In the first embodiment of the present invention shown in FIG. 2, the distributed element 21 made of the transmission line with the open end having a width of 0.094 mm and a length of 0.74 mm is formed on the ceramic substrate 22 having a dielectric constant of 10.5 and a thickness of 0.1 mm. The other circuit elements in FIG. 1 are formed on a semiconductor substrate 20. The dielectric constant and the thickness of the semiconductor substrate 20 are 13.5 and 0.08 mm, respectively, and the widths of the transmission lines of the distributed elements 2, 4, 11 and 13 are set to be 0.054 mm. Further, the resistors 7, 8, 16, and 17 are set to be 100 Ω and the chip capacitors 10 and 19 are set to be 100 pF. Also, the sizes of the input terminal 1 and the output terminals 6 and 15 are designed to be 0.1×0.12 mm.

Figure 3:
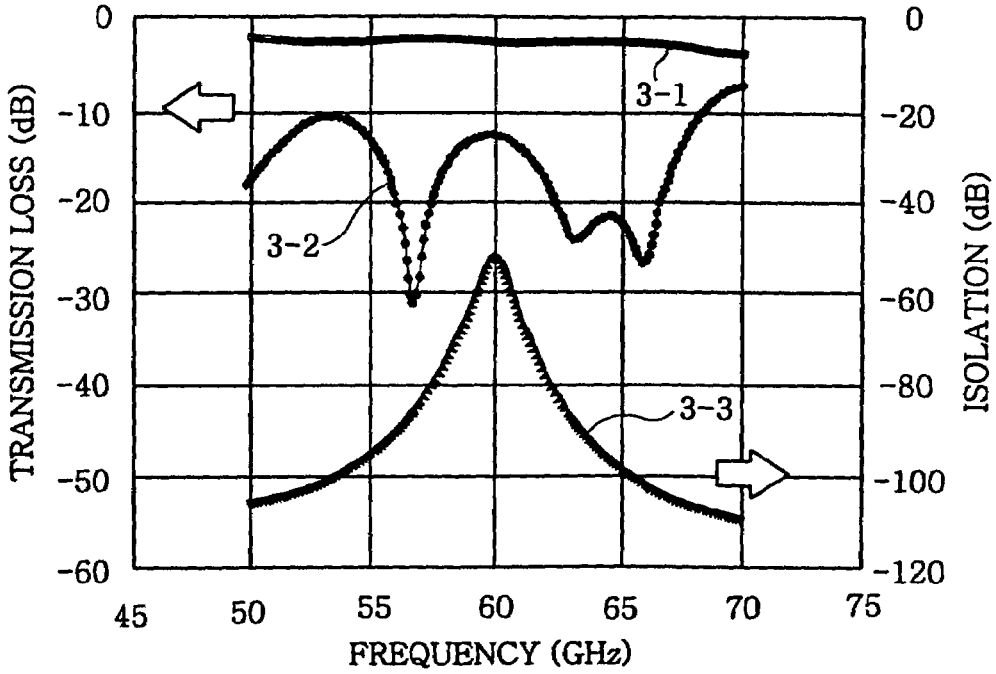
FIG. 3 sets forth a graph to explain estimated values of transmission loss of a high frequency signal of a frequency ranging from 50 to 70 GHz in accordance with the first embodiment of the present invention.

FIG. 3 sets forth a graph to describe estimated values of transmission loss of a high frequency signal of a frequency ranging from 50 to 70 GHz in the first embodiment having the configuration as illustrated in FIG. 2.

In FIG. 3, a curve 3-1 represents a transmission loss of the high frequency signal transmitted from the output terminal 6 to the output terminal 15 under the condition that the input terminal 1 is connected to the distributed element 21 and the turn-off resistances of the semiconductors 3, 5, 12 and 14 are set to be 2 kΩ. A curve 3-2 indicates a reflection loss of the high frequency signal at the output terminal 6 under the same condition. Further, a curve 3-3 depicts a transmission loss, i.e., isolation of the high frequency signal transmitted from the output terminal 6 to the output terminal 15 when the turn-on resistances of the semiconductors 3, 5, 12 and 14 are set to be 2Ω.

As can be seen from FIG. 3, by connecting the distributed element 21 to the input terminal 1, the reflection loss of the high frequency signal of the frequency ranging from 57 to 65 GHz at the output terminal 6 becomes 12 dB or greater, the influence of the input terminal 1 upon the transmission loss of the high frequency signal sent from the output terminal 6 to the output terminal 15 (that is, one of the output terminals is used as an input terminal) decreases, and the sum of the transmission loss of the high frequency signal transmitted from the input terminal 1 to the output terminal 6 when the turn-off resistances of the semiconductors 3 and 5 are 2 kΩ and the transmission loss of the high frequency signal transmitted from the input terminal 1 to the output terminal 15 when the turn-off resistances of the semiconductors 12 and 14 are 2 kΩ amounts to about 2.2 dB or less.

Figure 4:
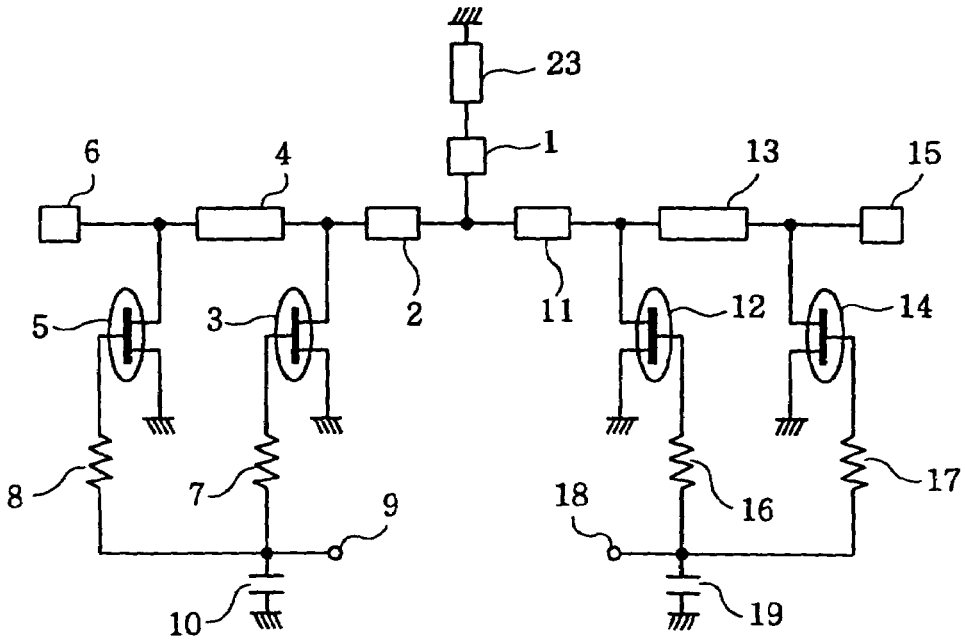
FIG. 4 provides a circuit diagram of a high frequency switch circuit device in accordance with a second preferred embodiment of the present invention.

Referring to FIG. 4, there is provided an equivalent circuit diagram to illustrate a circuit configuration of a high frequency switch circuit device in accordance with a second preferred embodiment of the present invention. Herein, reference numeral 23 represents a distributed element, and parts identical or equivalent to those described in the aforementioned drawings will be assigned same reference numerals.

As shown therein, an input terminal 1, a distributed element 2 made of a transmission line whose length is about 2n−1 times λ/4 (n represents a natural number), a distributed element 4 made of a transmission line whose length is about 2n times λ/4 and an output terminal 6 are sequentially connected in series. A semiconductor 3 for switching operation is connected to the distributed elements 2 and 4, while a semiconductor 5 for a switching operation is connected to the distributed element 4 and the output terminal 6. Further, resistors 7 and 8 for controlling the semiconductors 3 and 5, respectively, are connected to a control terminal 9 and are grounded via a chip capacitor 10.

Moreover, the input terminal 1, a distributed element 11 made of a transmission line whose length is about 2n−1 times λ/4, a distributed element 13 made of a transmission line whose length is about 2n times λ/4 and another output terminal 15 are sequentially connected in series. Also, a semiconductor 12 for switching operation is connected to the distributed elements 11 and 13 while a semiconductor 14 for switching operation is coupled to the distributed element 13 and the output terminal 15. Further, resistors 16 and 17 for controlling the semiconductors 12 and 14, respectively, are connected to a control terminal 18, and are grounded via a chip capacitor 19. In addition, the distributed element 23 made of a transmission line with a short-circuited end is connected to the input terminal 1, and the total length of the input terminal 1 and the transmission line of the distributed element 23 is set to be about integer times (λ/4+λ/2).

In this circuit configuration, if one of the output terminals 6 and 15 is used as an input port and the other is used as an output port such that a high frequency signal is outputted from the one of the output terminal to the other, an impedance due to the input terminal 1 and the distributed element 23 becomes infinite by setting the total length of the input terminal 1 and the transmission line of the distributed element 23 to be about integer times (λ/4+λ/2). As a consequence, a reflection of the high frequency signal from the input terminal 1 does not influence upon the transmission loss thereof.

Figure 5:
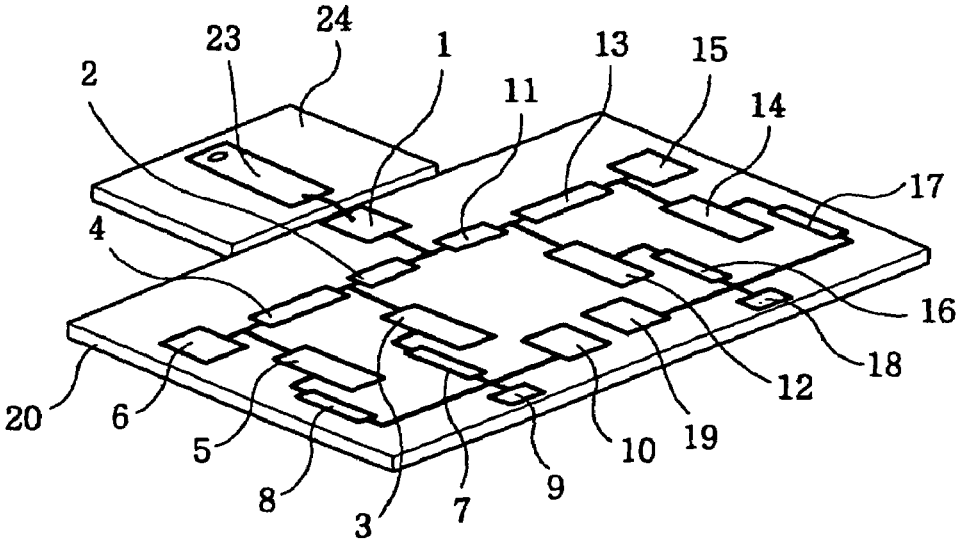
FIG. 5 shows a configuration of the high frequency switch circuit device obtained by forming the circuit in FIG. 4 on a substrate in accordance with the second embodiment of the present invention.

FIG. 5 illustrates a configuration of the high frequency switch circuit device obtained by forming the circuit in FIG. 4 on a substrate in accordance with the second embodiment of the present invention. Reference numeral 24 represents a substrate. Herein, parts identical to or equivalent to those descried in FIG. 4 will be assigned same reference numerals, and description thereof will be omitted.

In FIG. 5, the distributed element 23 made of the transmission line with the short-circuited end having a width of 0.094 mm and a length of 1.22 mm is formed on the ceramic substrate 24 having a dielectric constant of 10.5 and a thickness of 0.1 mm. The other circuit elements in FIG. 4 are formed on a semiconductor substrate 20. The dielectric constant and the thickness of the semiconductor substrate 20 are 13.5 and 0.08 mm, respectively, and the widths of the transmission lines of the distributed elements 2, 4, 11 and 13 are set to be 0.054 mm. Further, the resistors 7, 8, 16, and 17 are set to be 100 Ω and the chip capacitors 10 and 19 are set to be 100 pF. Also, the sizes of the input terminal 1 and the output terminals 6 and 15 are designed to be 0.1×0.12 mm.

Figure 6:
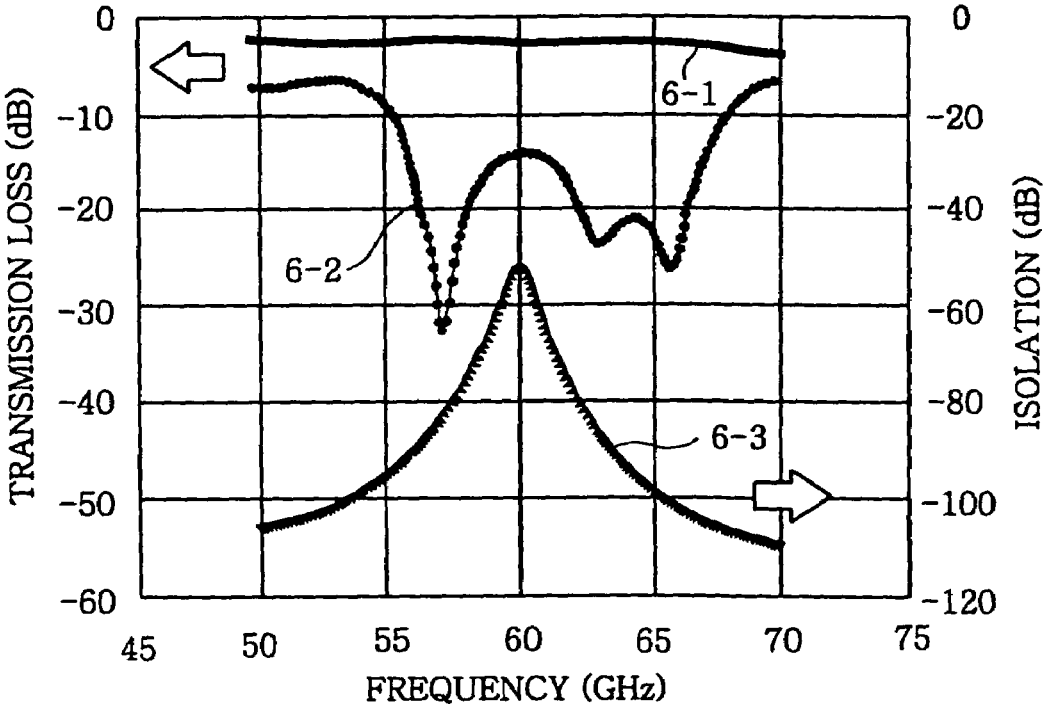
FIG. 6 depicts a graph to explain estimated values of transmission loss of a high frequency signal of a frequency ranging from 50 to 70 GHz in accordance with the second embodiment of the present invention.

FIG. 6 sets forth a graph to describe estimated values of transmission loss of a high frequency signal of a frequency ranging from 50 to 70 GHz in the second embodiment having the configuration as illustrated in FIG. 5.

In FIG. 6, a curve 6-1 represents a transmission loss of the high frequency signal transmitted from the output terminal 6 to the output terminal 15 under the condition that the input terminal 1 is connected to the distributed element 23 and the turn-off resistances of the semiconductors 3, 5, 12 and 14 are set to be 2 kΩ. A curve 6-2 indicates a reflection loss of the high frequency signal at the output terminal 6 under the same condition. Further, a curve 6-3 depicts a transmission loss, i.e., isolation of the high frequency signal transmitted from the output terminal 6 to the output terminal 15 when the turn-on resistances of the semiconductors 3, 5, 12 and 14 are set to be 2Ω.

As can be seen from FIG. 6, by connecting the distributed element 23 to the input terminal 1, the reflection loss of the high frequency signal of the frequency ranging from 57 to 65 GHz at the output terminal 6 becomes 15 dB or greater, the influence of the input terminal 1 upon the transmission loss of the high frequency signal sent from the output terminal 6 used as an input terminal to the output terminal 15 decreases, and the sum of the transmission loss of the high frequency signal transmitted from the input terminal 1 to the output terminal 6 when the turn-off resistances of the semiconductors 3 and 5 are 2 kΩ and the transmission loss of the high frequency signal transmitted from the input terminal 1 to the output terminal 15 when the turn-off resistances of the semiconductors 12 and 14 are 2 kΩ amounts to about 2.3 dB or less.

In accordance with the first and the second embodiment shown in FIGS. 1 and 2 and FIGS. 3 and 4, respectively, although the distributed element 21 made of the transmission line with the open end or the distributed element 23 made of the transmission line with the short-circuited end is formed on the substrate 22 or 24 having the dielectric constant of 10.5, the source material of the substrate is not limited to a specific material as long as the distributed element is made of a transmission line with an open end which is configured such that the total length of the input terminal 1 and the transmission line is about integer times λ/2 or a transmission line with a short-circuited end which is configured such that the total length of the input terminal 1 and the transmission line is about integer times (λ/4+λ/2). Further, if the circuit device is used for switching a high frequency signal inputted from the input terminal 1 to be outputted to either of the output terminals 6 and 15 by turning on/off the semiconductors 3, 5, 12 and 14, the distributed element 21 made of the transmission line with the open end formed on the ceramic substrate 22 or the distributed element 23 made of the transmission line with the short-circuited end formed on the ceramic substrate 24 is not essential thereto.

Figure 7:
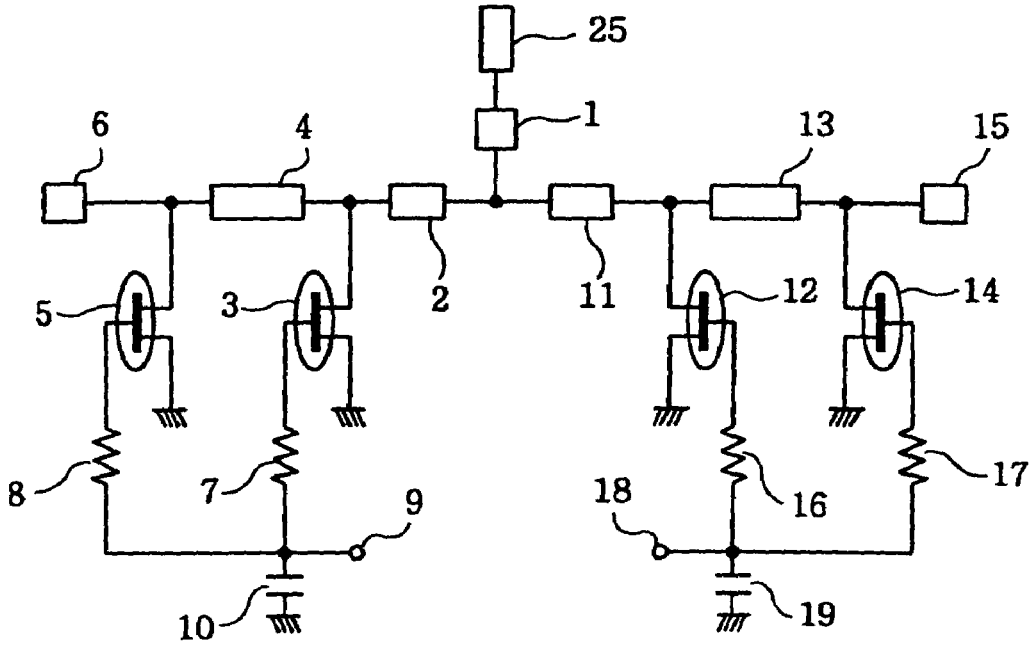
FIG. 7 offers a circuit diagram of a high frequency switch circuit device in accordance with a third preferred embodiment of the present invention.

Referring to FIG. 7, there is provided an equivalent circuit diagram to illustrate a circuit configuration of a high frequency switch circuit device in accordance with a third preferred embodiment of the present invention. Herein, reference numeral 25 represents a distributed element, and parts identical or equivalent to those described in the aforementioned drawings will be assigned same reference numerals.

As shown therein, an input terminal 1, a distributed element 2 made of a transmission line whose length is about 2n−1 times λ/4 (n represents a natural number), a distributed element 4 made of a transmission line whose length is about 2n times λ/4 and an output terminal 6 are sequentially connected in series. A semiconductor 3 for switching operation is connected to the distributed elements 2 and 4, while a semiconductor 5 for a switching operation is connected to the distributed element 4 and the output terminal 6. Further, resistors 7 and 8 for controlling the semiconductors 3 and 5, respectively, are connected to a control terminal 9 and are grounded via a chip capacitor 10. Moreover, the input terminal 1, a distributed element 11 made of a transmission line whose length is about 2n−1 times λ/4, a distributed element 13 made of a transmission line whose length is about 2n times λ/4 and another output terminal 15 are sequentially connected in series. Also, a semiconductor 12 for switching operation is connected to the distributed elements 11 and 13 while a semiconductor 14 for switching operation is coupled to the distributed element 13 and the output terminal 15. Further, resistors 16 and 17 for controlling the semiconductors 12 and 14, respectively, are connected to a control terminal 18, and are grounded via a chip capacitor 19. In addition, the distributed element 25 made of a transmission line with an open end is connected to the input terminal 1, and the total length of the input terminal 1 and the transmission line of the distributed element 25 is set to be about integer times λ/2.

In this circuit configuration, if one of the output terminals 6 and 15 is used as an input port and the other is used as an output port such that a high frequency signal is outputted from the one of the output terminal to the other, an impedance due to the input terminal 1 and the distributed element 25 becomes infinite by setting the total length of the input terminal 1 and the transmission line of the distributed element 25 to be about integer times λ/2. As a consequence, a reflection of the high frequency signal from the input terminal 1 does not influence upon the transmission loss thereof.

Figure 8:
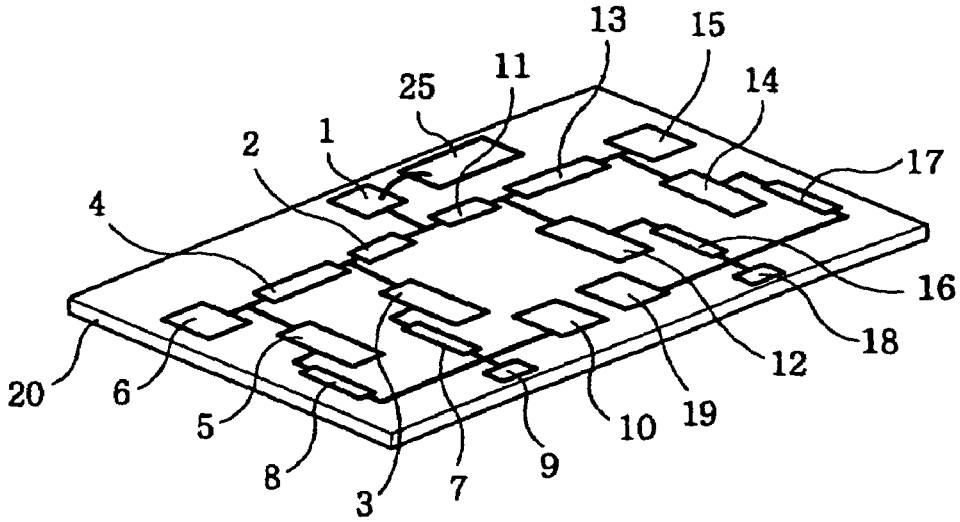
FIG. 8 illustrates a configuration of the high frequency switch circuit device obtained by forming the circuit in FIG. 7 on a substrate in accordance with the third embodiment of the present invention.

FIG. 8 illustrates a configuration of the high frequency switch circuit device obtained by forming the circuit in FIG. 7 on a substrate in accordance with the third embodiment of the present invention. Here, parts identical or equivalent to those described in the aforementioned drawings will be assigned same reference numerals, and description thereof will be omitted.

In FIG. 8, the distributed element 25 made of the transmission line with the open end having a width of 0.054 mm and a length of 0.64 mm is formed on a semiconductor substrate 20 to be connected with the input terminal 1 by wire bonding. The other circuit elements in FIG. 7 are also formed on a semiconductor substrate 20. The dielectric constant and the thickness of the semiconductor substrate 20 are 13.5 and 0.08 mm, respectively, and the widths of the transmission lines of the distributed elements 2, 4, 11 and 13 are set to be 0.054 mm. Further, the resistors 7, 8, 16, and 17 are set to be 100 Ω and the chip capacitors 10 and 19 are set to be 100 pF. Also, the sizes of the input terminal 1 and the output terminals 6 and 15 are designed to be 0.1×0.12 mm.

Figure 9:
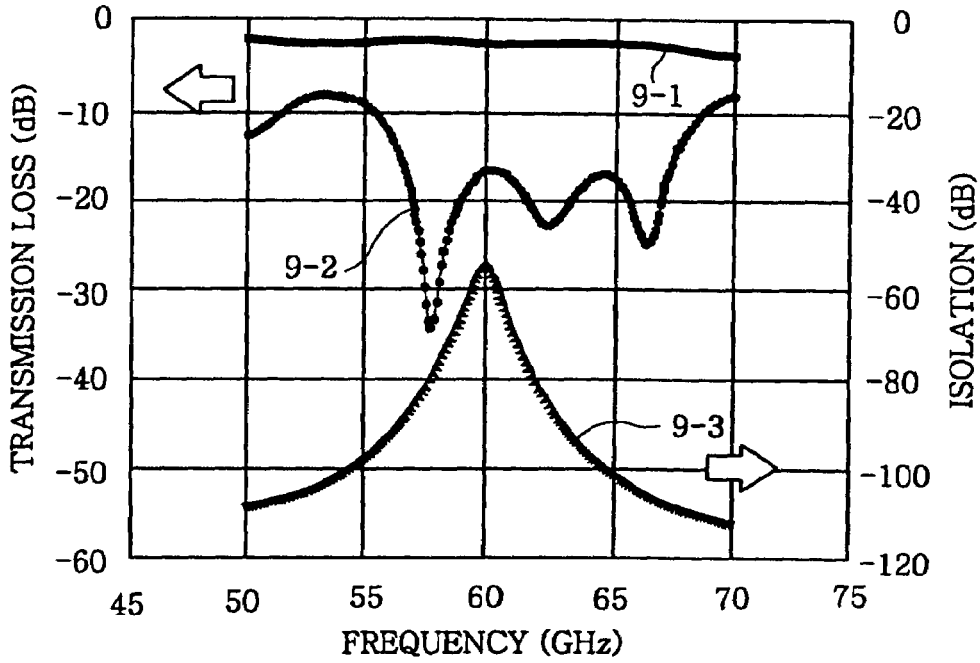
FIG. 9 presents a graph to explain estimated values of transmission loss of a high frequency signal of a frequency ranging from 50 to 70 GHz in accordance with the third embodiment of the present invention.

FIG. 9 sets forth a graph to describe estimated values of transmission loss of a high frequency signal of a frequency ranging from 50 to 70 GHz in the third embodiment having the configuration as illustrated in FIG. 8.

In FIG. 9, a curve 9-1 represents a transmission loss of the high frequency signal transmitted from the output terminal 6 serving as an input terminal to the output terminal 15 under the condition that the input terminal 1 is connected to the distributed element 25 and the turn-off resistances of the semiconductors 3, 5, 12 and 14 are set to be 2 kΩ. A curve 9-2 indicates a reflection loss of the high frequency signal at the output terminal 6 under the same condition. Further, a curve 9-3 depicts a transmission loss, i.e., isolation of the high frequency signal transmitted from the output terminal 6 to the output terminal 15 when the turn-on resistances of the semiconductors 3, 5, 12 and 14 are set to be 2Ω.

As can be seen from FIG. 9, by connecting the distributed element 25 to the input terminal 1, the reflection loss of the high frequency signal of the frequency ranging from 57 to 65 GHz at the output terminal 6 becomes 15 dB or greater, the influence of the input terminal 1 upon the transmission loss of the high frequency signal sent from the output terminal 6 to the output terminal 15 decreases, and the sum of the transmission loss of the high frequency signal transmitted from the input terminal 1 to the output terminal 6 when the turn-off resistances of the semiconductors 3 and 5 are 2 kΩ and the transmission loss of the high frequency signal transmitted from the input terminal 1 to the output terminal 15 when the turn-off resistances of the semiconductors 12 and 14 are 2 kΩ amounts to about 2.3 dB or less.

Figure 10:
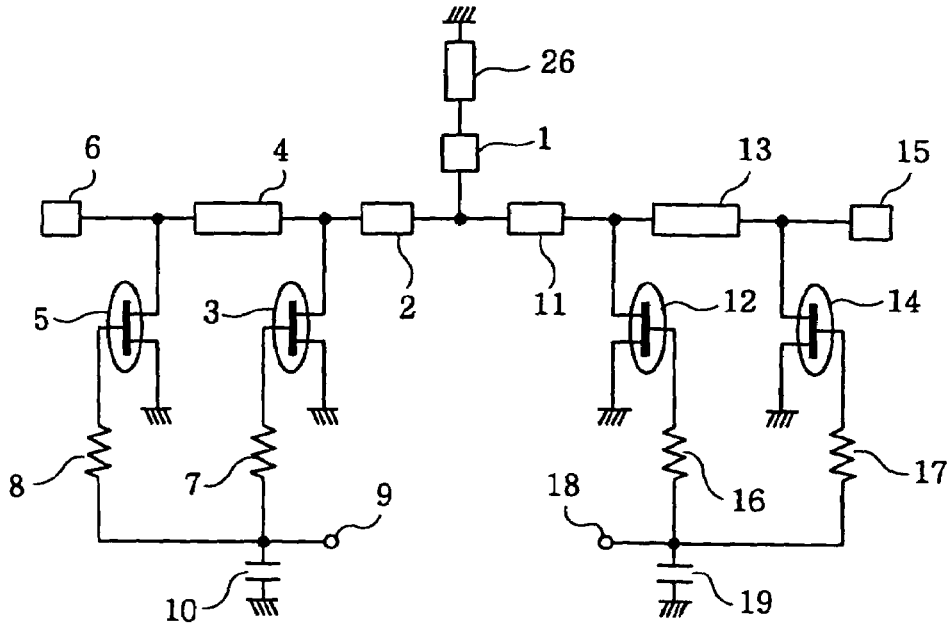
FIG. 10 exhibits a circuit diagram of a high frequency switch circuit device in accordance with a fourth preferred embodiment of the present invention.

Referring to FIG. 10, there is provided an equivalent circuit diagram to illustrate a circuit configuration of a high frequency switch circuit device in accordance with a fourth preferred embodiment of the present invention. Herein, reference numeral 26 represents a distributed element, and parts identical or equivalent to those described in the aforementioned drawings will be assigned same reference numerals.

As shown therein, an input terminal 1, a distributed element 2 made of a transmission line whose length is about 2n−1 times λ/4 (n represents a natural number), a distributed element 4 made of a transmission line whose length is about 2n times λ/4 and an output terminal 6 are sequentially connected in series. A semiconductor 3 for switching operation is connected to the distributed elements 2 and 4, while a semiconductor 5 for a switching operation is connected to the distributed element 4 and the output terminal 6. Further, resistors 7 and 8 for controlling the semiconductors 3 and 5, respectively, are connected to a control terminal 9 and are grounded via a chip capacitor 10.

Moreover, the input terminal 1, a distributed element 11 made of a transmission line whose length is about 2n−1 times λ/4, a distributed element 13 made of a transmission line whose length is about 2n times λ/4 and another output terminal 15 are sequentially connected in series. Also, a semiconductor 12 for switching operation is connected to the distributed elements 11 and 13 while a semiconductor 14 for switching operation is coupled to the distributed element 13 and the output terminal 15. Further, resistors 16 and 17 for controlling the semiconductors 12 and 14, respectively, are connected to a control terminal 18, and are grounded via a chip capacitor 19. In addition, the distributed element 26 made of a transmission line with a short-circuited end is connected to the input terminal 1, and the total length of the input terminal 1 and the transmission line of the distributed element 26 is set to be about integer times (λ/4+λ/2).

In this circuit configuration, if one of the output terminals 6 and 15 is used as an input port and the other is used as an output port such that a high frequency signal is outputted from the one of the output terminal to the other, an impedance due to the input terminal 1 and the distributed element 26 becomes infinite by setting the total length of the input terminal 1 and the transmission line of the distributed element 26 to be about integer times (λ/4+λ/2). As a consequence, a reflection of the high frequency signal from the input terminal 1 does not influence upon the transmission loss thereof.

Figure 11:
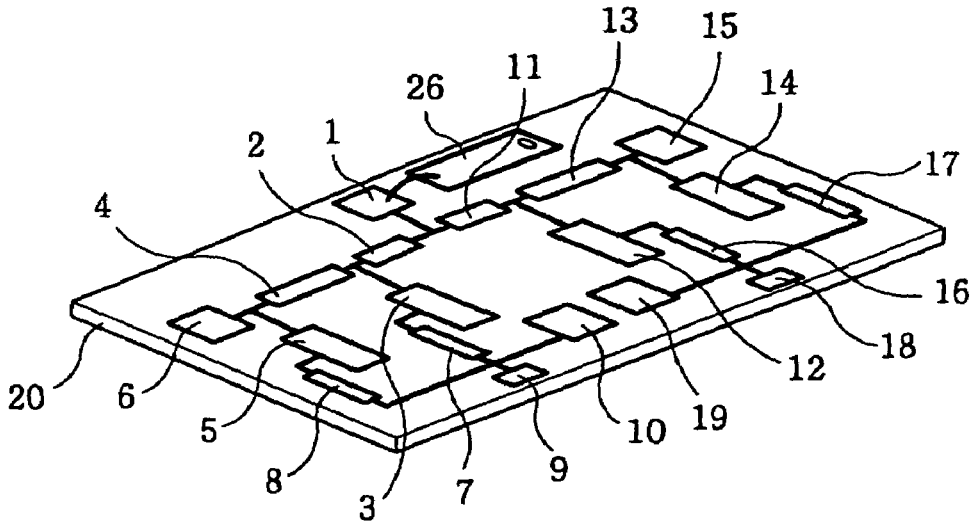
FIG. 11 describes a configuration of the high frequency switch circuit device obtained by forming the circuit in FIG. 10 on a substrate in accordance with the fourth embodiment of the present invention.

FIG. 11 illustrates a configuration of the high frequency switch circuit device obtained by forming the circuit in FIG. 10 on a substrate in accordance with the fourth embodiment of the present invention. Herein, parts identical or equivalent to those described in the aforementioned drawings will assigned same reference numerals, and description thereof will be omitted.

In FIG. 11, the distributed element 26 made of the transmission line with the short-circuited end having a width of 0.054 mm and a length of 1.08 mm is formed on a semiconductor substrate 20 to be connected with the input terminal 1 by wire bonding. The other circuit elements in FIG. 10 are also formed on a semiconductor substrate 20. The dielectric constant and the thickness of the semiconductor substrate 20 are 13.5 and 0.08 mm, respectively, and the widths of the transmission lines of the distributed elements 2, 4, 11 and 13 are set to be 0.054 mm. Further, the resistors 7, 8, 16, and 17 are set to be 100 Ω and the chip capacitors 10 and 19 are set to be 100 pF. Also, the sizes of the input terminal 1 and the output terminals 6 and 15 are designed to be 0.1×0.12 mm.

Figure 12:
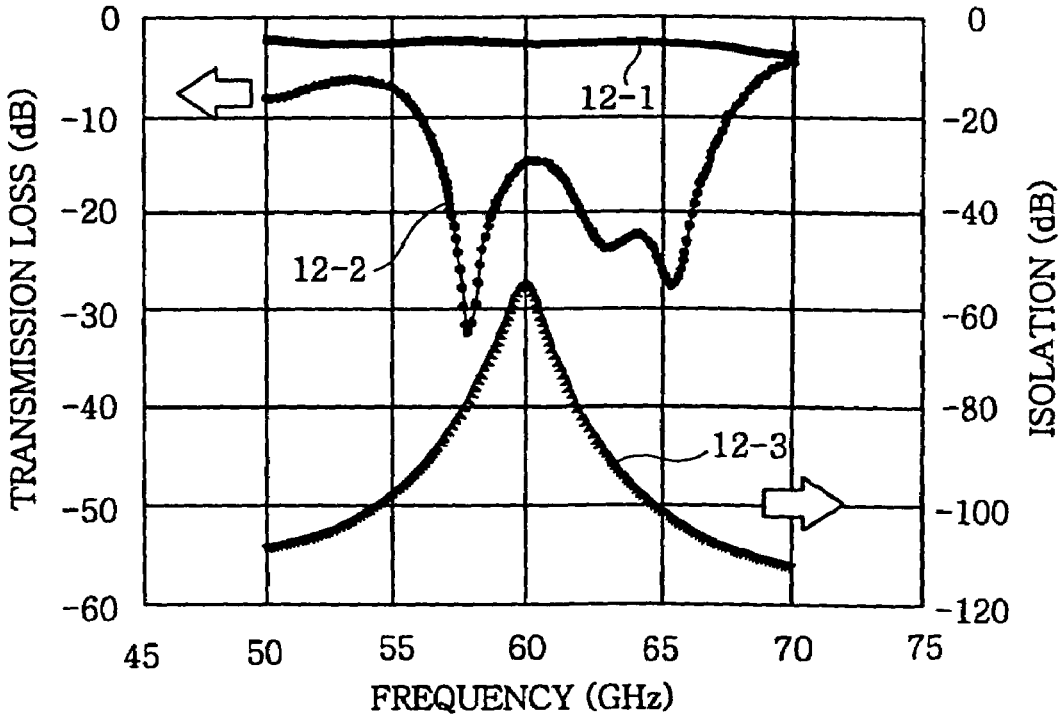
FIG. 12 sets forth a graph to explain estimated values of transmission loss of a high frequency signal of a frequency ranging from 50 to 70 GHz in accordance with the fourth embodiment of the present invention.

FIG. 12 sets forth a graph to describe estimated values of transmission loss of a high frequency signal of a frequency ranging from 50 to 70 GHz in the third embodiment having the configuration as illustrated in FIG. 11.

In FIG. 12, a curve 12-1 represents a transmission loss of the high frequency signal transmitted from the output terminal 6 serving as an input terminal to the other output terminal 15 under the condition that the input terminal 1 is connected to the distributed element 26, the turn-off resistances of the semiconductors 3, 5, 12 and 14 are set to be 2 kΩ. A curve 12-2 indicates a reflection loss of the high frequency signal at the output terminal 6 under the same condition. Further, a curve 12-3 depicts a transmission loss, i.e., isolation of the high frequency signal transmitted from the output terminal 6 to the output terminal 15 when the turn-on resistances of the semiconductors 3, 5, 12 and 14 are set to be 2Ω.

As can be seen from FIG. 12, by connecting the distributed element 26 to the input terminal 1, the reflection loss of the high frequency signal of the frequency ranging from 57 to 65 GHz at the output terminal 6 becomes 15 dB or greater, the influence of the input terminal 1 upon the transmission loss of the high frequency signal sent from the output terminal 6 to the output terminal 15 decreases, and the sum of the transmission loss of the high frequency signal transmitted from the input terminal 1 to the output terminal 6 when the turn-off resistances of the semiconductors 3 and 5 are 2 kΩ and the transmission loss of the high frequency signal transmitted from the input terminal 1 to the output terminal 15 when the turn-off resistances of the semiconductors 12 and 14 are 2 kΩ amounts to about 2.4 dB or less.

In accordance with the third and the fourth embodiment of the present invention shown in FIGS. 7 and 8 and FIGS. 10 and 11, respectively, the distributed element 25 made of the transmission line with the open end or the distributed element 26 made of the transmission line with the short-circuited end is formed on the semiconductor substrates 20 to be connected to the input terminal 1 by wire bonding or the like. However, if the switch circuit device is to be used for switching a high frequency signal inputted to the input terminal 1 to be outputted from either of the output terminals 6 and 15 by turning on/off the semiconductors 3, 5, 12 and 14, said wire bonding or the like is not used.

Furthermore, although the above-described preferred embodiments have been described for the case where two output terminals are included therein, it is also possible for output terminals to be more than two. In such a case, two distributed elements of transmission lines with predetermined lengths are connected between the input terminal 1 and each of the output terminals in series. Also, a semiconductor is connected to the two distributed elements and a semiconductor is connected to the output terminal and the distributed element at the side of the output terminal.

In accordance with the present invention, it is possible to reduce a transmission loss of a semiconductor switch circuit device for switching on/off output terminals by providing a high frequency switching circuit device including at least one input terminal and at least two output terminals, wherein the transmission line, having an open end or a short-circuited end, is connected to the input terminal, and a total length of the input terminal and the transmission line is set to be about integer times λ/2 in case the transmission line has the open end and about integer times (λ/4+λ/2) in case the transmission line has the short-circuited end.

In accordance with the present invention, it is possible to reduce a transmission loss of a semiconductor switch circuit device for switching on/off input terminals by providing a high frequency switching circuit device including at least one output terminal and at least two input terminals, wherein the transmission line, having an open end or a short-circuited end, is connected to the output terminal, and a total length of the output terminal and the transmission line is set to be about integer times λ/2 in case the transmission line has the open end and about integer times (λ/4+λ/2) in case the transmission line has the short-circuited end.

In addition, in accordance with the present invention, it is easy to reduce the size of the switch circuit device by using a dielectric material of a high dielectric constant as a source material of the substrate on which the distributed element of the transmission line with the open end or the distributed element of the transmission line with the short-circuited end.

While the invention has been shown and descried with respect to the preferred embodiments, it will be understood by those skilled in the art that various changes and modifications may be made without departing from the spirit and scope of the invention as defined in the following claims.

What is claimed is:

1. A high frequency switch circuit device comprising:

at least one distributed element of at least one transmission line;

lumped elements of at least one resistor and at least one capacitor;

at least one semiconductor device;

at least one input terminal;

at least two output terminals; and another transmission line, having an open end or a short-circuited end, connected to the input terminal, wherein a total length of the input terminal and said another transmission line is set to be about an integer times $\lambda/2$ in case the transmission line has the open end and about an integer times $(\lambda/4+\lambda/2)$ in case the transmission line has the short-circuited end.

2. The device of claim 1, wherein one of the output terminals is used as an input port to which a signal is inputted, and another one of the output terminals is used as an output port from which a signal is outputted.

3. The device of claim 1, wherein said another transmission line connected to the input terminal is formed on a dielectric substrate or a semiconductor substrate.

4. A high frequency switch circuit device comprising:

at least one distributed element of at least one transmission line;

two lumped elements of at least one resistor and at least one capacitor;

at least one semiconductor device;

at least one output terminal;

at least two input terminals; and another transmission line, having an open end or a short-circuited end, connected to the output terminal, wherein a total length of the output terminal and said another transmission line is set to be about an integer times $\lambda/2$ in case the transmission line has the open end and about an integer times $(\lambda/4+\lambda/2)$ in case the transmission line has the short-circuited end.

5. The device of claim 4, wherein one of the input terminals is used as an input port to which a signal is inputted, and another one of the input terminals is used as an output port from which a signal is outputted.

6. The device of claim 4, wherein said another transmission line connected to the output terminal is formed on a dielectric substrate or a semiconductor substrate.

* * * * *

UNITED STATES PATENT AND TRADEMARK OFFICE

CERTIFICATE OF CORRECTION

PATENT NO. : 7,280,006 B2
APPLICATION NO. : 11/256921
DATED : October 9, 2007
INVENTOR(S) : Eiichi Hase It is certified that error appears in the above-identified patent and that said Letters Patent is hereby corrected as shown below:

Title Page, Item (73) Assignee: should read -- Hitachi Kokusai Electric Inc., Tokyo (JP) --

Signed and Sealed this

Twentieth Day of May, 2008

JON W. DUDAS
*Director of the United States Patent and Trademark Office*